US006112373A

United States Patent [19]

Steinhauer et al.

[11] Patent Number: 6,112,373

[45] Date of Patent: Sep. 5, 2000

[54] CLASP ASSEMBLY

[75] Inventors: David Steinhauer, North Easton; Byron Sandoval, Revere, both of Mass.

[73] Assignee: Goldman Kolber, Inc., Norwood, Mass.

[21] Appl. No.: 09/457,029

[22] Filed: Dec. 8, 1999

[51] Int. Cl.[7] ..... A44B 19/00; A44B 11/26

[52] U.S. Cl. ..... 24/68 J; 63/3.1; 24/615; 24/616

[58] Field of Search ..... 24/685, 695, 70 J, 24/616, 163 K, 573.1, 573.5, 15, 654, 652, 583, 116 A, 265 EC, 265 BC; 403/319, 364, 341, 286; 63/3.1, 3

[56] References Cited

U.S. PATENT DOCUMENTS

| | | | |
|---|---|---|---|
| D. 373,325 | 9/1996 | Koven . | |
| 1,441,999 | 1/1923 | Posner | 24/616 |
| 1,807,293 | 5/1931 | Keller | 24/616 |
| 4,170,809 | 10/1979 | Geldwerth et al. . | |
| 4,426,854 | 1/1984 | Geldwerth et al. . | |
| 4,520,537 | 6/1985 | Valikov . | |
| 4,543,692 | 10/1985 | Ode et al. . | |
| 4,881,305 | 11/1989 | Rivera . | |
| 4,907,322 | 3/1990 | Kanno | 24/616 |
| 5,099,551 | 3/1992 | Hyun | 24/116 A X |
| 5,231,740 | 8/1993 | Mohebkhosravi . | |
| 5,272,795 | 12/1993 | Rothstein . | |
| 5,311,647 | 5/1994 | Levy . | |
| 5,341,659 | 8/1994 | Wright | 24/573.3 X |
| 5,349,725 | 9/1994 | Levy . | |
| 5,435,047 | 7/1995 | Colpo | 24/616 X |
| 5,678,282 | 10/1997 | Stewart . | |

*Primary Examiner*—Anthony Knight
*Assistant Examiner*—Robert J. Sandy
*Attorney, Agent, or Firm*—Samuels, Gauthier & Stevens, LLP

[57] ABSTRACT

An improved clasp assembly which can be readily detached and reconnected to one or more strand ends, the latter being configured to be passed through jewelry components being slidably mounted on the strands. One embodiment of the clasp assembly comprises a catch permanently secured to one strand end, and a housing detachably secured to the other strand end. The catch is separably received in snap engagement within the housing, and the housing includes a latch mechanism accommodating its detachment and reattachment to the other strand end without the need to employ specialized tools or to involve jewelers.

15 Claims, 3 Drawing Sheets

FIG. 3
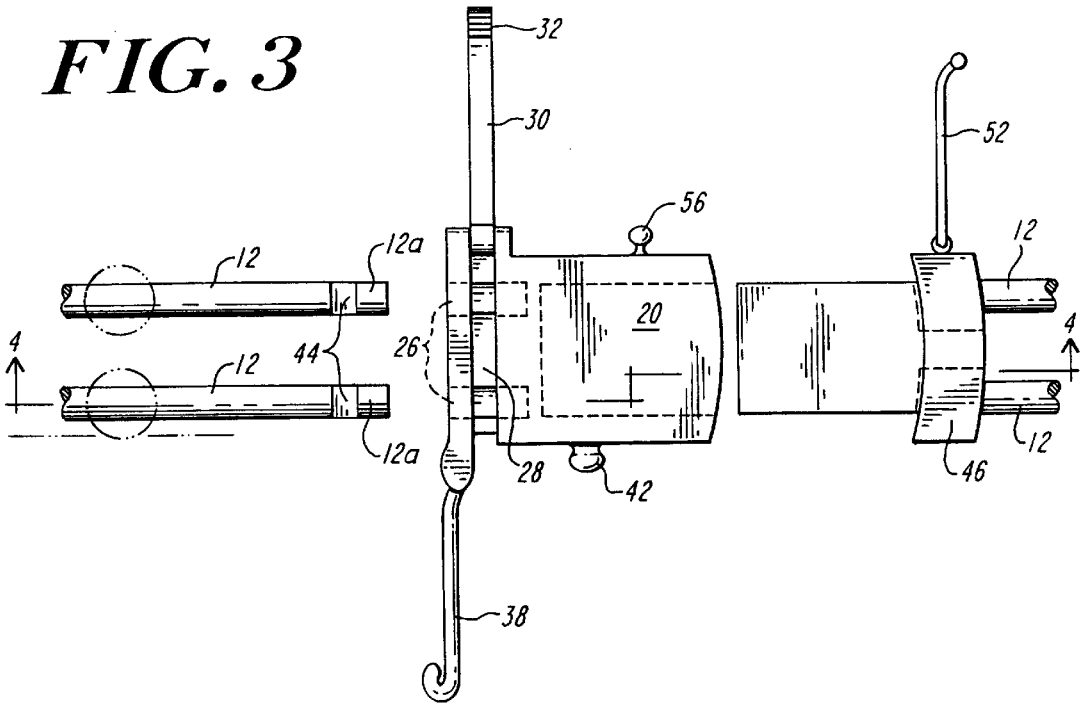
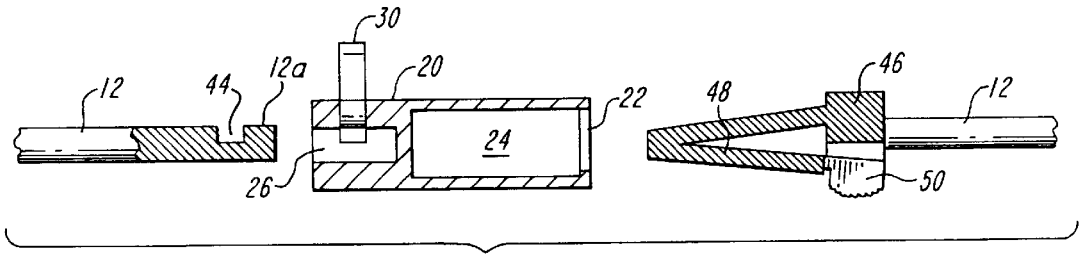
FIG. 4
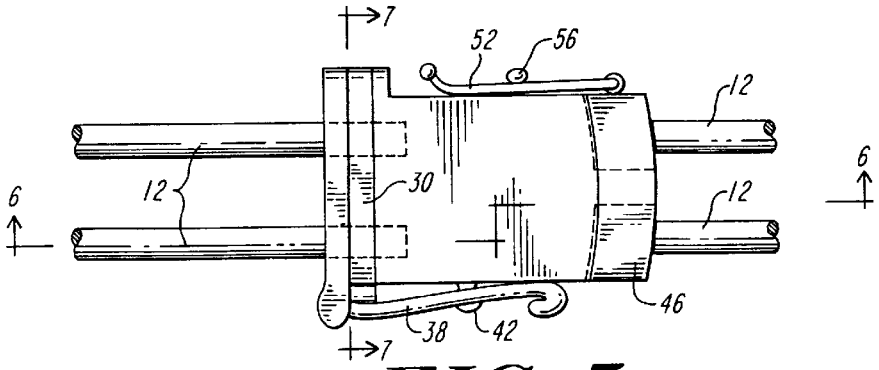
FIG. 5

CLASP ASSEMBLY

FIELD OF THE INVENTION

This invention relates to jewelry clasps, and in particular to clasps useful in slide bracelets and necklaces.

BACKGROUND OF THE INVENTION

In slide bracelets, necklaces and the like, interchangeable jewelry pieces commonly referred to as "slides" are slidably received on either single or plural wire cables, chains or other like flexible elements hereinafter collectively referred to as "strands". The slides are held in place by friction on the strands and clasps are employed to separably couple the ends of the strands.

The clasps typically include mating components secured to the strand ends. At least one of the clasp components must be detached from its respective strand end in order to accommodate removal and replacement of the slides. The detached clasp component must then be carefully reattached in order to preserve the integrity of the clasp. Failure to do so can result in an uncoupling of the strand ends, and loss of the bracelet or necklace.

The aforesaid detachment and reattachment of slide clasp components has typically required the attention of jewelers who posses the skills and specialized tools needed to perform such tasks in a reliable manner. The attendant cost and inconvenience of having to involve jewelers when interchanging slides often discourages users from doing so.

SUMMARY OF THE INVENTION

The present invention is directed to an improved clasp assembly which can be readily detached and reconnected to one or more strand ends, the latter being configured to be passed through jewelry components being slidably mounted on the strands. A preferred embodiment of the class assembly comprises a catch permanently secured to one strand end, and a housing detachably secured to the other strand end. The catch is separably received in snap engagement within the housing, and the housing includes a latch mechanism accommodating its detachment and reattachment to the other strand end, in a simple straightforward manner, without the need to employ specialized tools or to involve jewelers.

These and other objects and advantages of the present invention will now be described in greater detail with reference to the accompanying drawings, wherein:

BRIEF DESCRIPTION OF THE DRAWINGS

FIG. 3 is an exploded top plan view of the claps assembly;

FIG. 4 is a sectional view of the exploded clasp components taken along line 4—4 of FIG. 3;

FIG. 5 is a top plan view of the clasp assembly in its assembled state, as shown in FIG. 1;

DETAILED DESCRIPTION OF PREFERRED EMBODIMENTS

Figure 1:
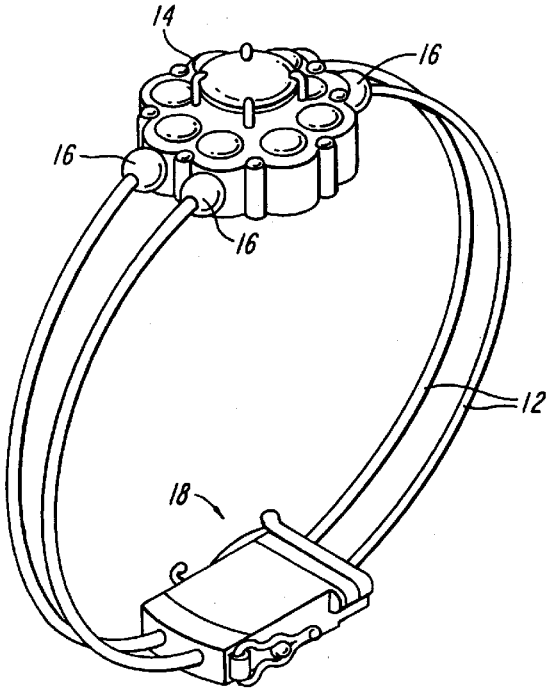
FIG. 1 is a perspective view of a typical slide bracelet incorporating a clasp assembly in accordance with one embodiment of the present invention.

Referring initially to FIG. 1, a typical slide bracelet 10 is shown comprising dual strands 12 on which a slide 14 has been slidably mounted, along with slidably mounted retaining beads 16. The ends of the strands 12 are separably coupled together by a clasp assembly 18 in accordance with the present invention.

With reference now to the remaining Figures, it will be seen that the clasp assembly 18 includes a housing 20 having a first opening 22 communicating with an internal chamber 24, and second openings 26 communicating with an external recess 28.

Figure 2:
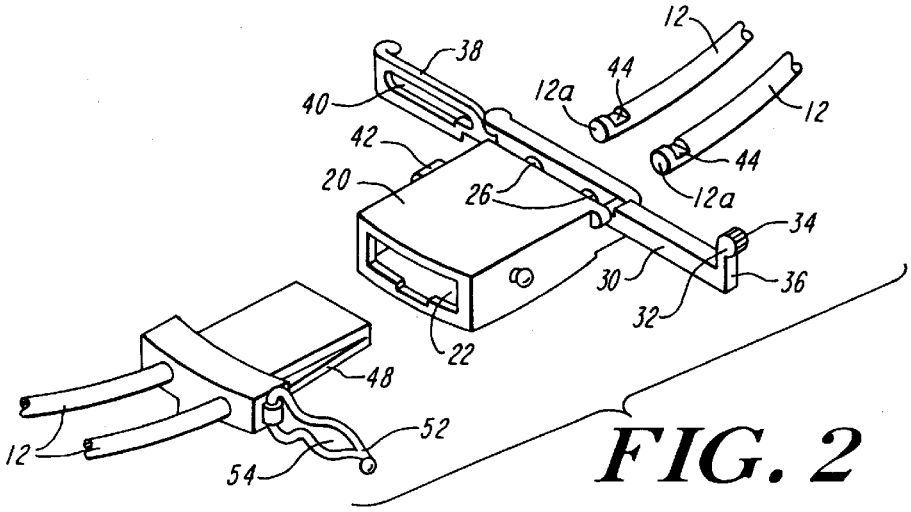
FIG. 2 is an exploded perspective view of the clasp shown in FIG. 1.
Figure 6:
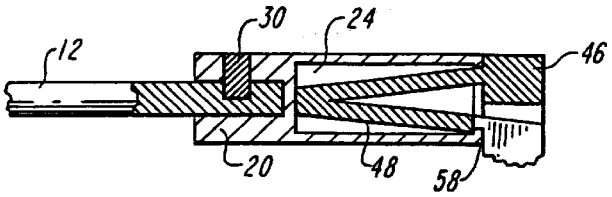
FIGS. 6 and 7 are sectional views taken respectively along lines 6—6 and 7—7 of FIG. 5.

A latch 30 is pivotally mounted on one side of the housing for adjustment between an open position removed from the recess 28, as shown in FIGS. 2, 3 and 4, and a closed position received in the recess 28, as shown in FIGS. 1 and 5–8. The latch 30 has an ear 32 at its distal end which is serrated as at 34 and which is configured to define an external notch 36.

Figure 7:
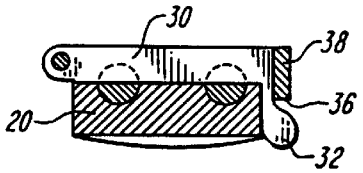
Figure 8:
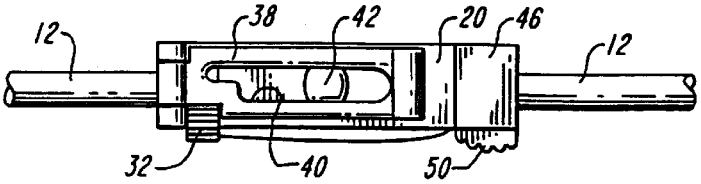
FIG. 8 is a side view of the assembled clasp.

A second latch 38 is pivotally mounted on the opposite side of the housing for pivotal movement between an unlocked position, as shown in FIGS. 2 and 3, and a locked position as shown in FIGS. 5, 7 and 8. The latch 38 is releasably retained in its locked position by a slot 40 which coacts in snap engagement with a button 42 on the side of the housing.

The ends 12*a* of the strands 12 are notched as at 44. The strand ends 12*a* are receivable in the recess 28 via openings 26, with the notches 44 facing outwardly. The latch 30 is then closed to coact in interengagement with the notches 44, thereby securing the strand ends 12*a* to the housing 20. The second latch 38 is then pivoted to its locked position, at which as can best be seen in FIG. 7, it coacts in engagement with the notch 36 on the ear 32 to retain the latch 30 in its closed position.

The opposite strand ends are permanently joined to a catch 46 having a resilient tongue 48 terminating in a serrated head 50. Catch 46 also has a third pivotal latch 52 with a shaped slot 54 configured to coact in snap engagement with a second button 56 on the housing 20.

The catch is receivable in the internal housing chamber 24 via opening 22. The tongue 48 coacts in resilient snap engagement as at 58 (see FIG. 6) with an edge of the opening 22 when in its inserted position within the housing. The third latch 52 is then closed to coact in snap engagement with the button 56 to insure that the catch remains securely seated within the housing 20.

In light of the foregoing, it will thus be seen that by simply manipulating the latch 52 and depressing the tongue 48, the catch 46 can be readily separated from and reattached to the housing 20 when donning and removing the bracelet.

If the slide 14 is to be replaced with another, or additional slides added to the bracelet, one need only manipulate the latches 30 and 38 to separate and then reconnect the strand ends 12*a* from and to the housing 20. No special skills or tools are required to do so.

Figure 1A:
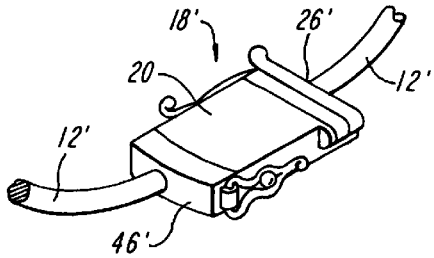
FIG. 1A is a perspective view of an alternative embodiment of the inventive clasp employed to couple the ends of a single strand necklace.

As shown in FIG. 1A, a modified clasp 18' may be employed to couple the ends of a single strand 12'. In this case, the catch 46' is secured to one strand end, and the housing 20' has only a single opening 26'. In all other respects, the clasp 18' may be identical to the clasp 18 shown in FIGS. 1–8.

Figure 9:
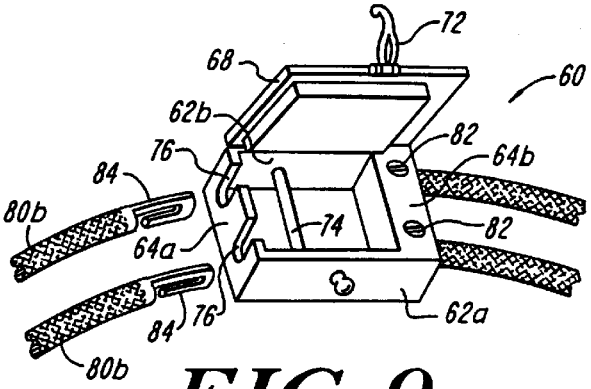
FIG. 9 is a perspective view of another embodiment of a clasp assembly in accordance with the present invention, with the clasp cover opened.
Figure 10:
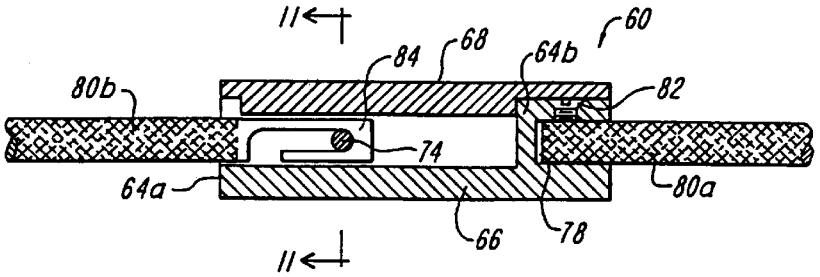
FIG. 10 is a longitudinal sectional view through the clasp assembly of FIG. 9, with the cover in a closed position.
Figure 11:
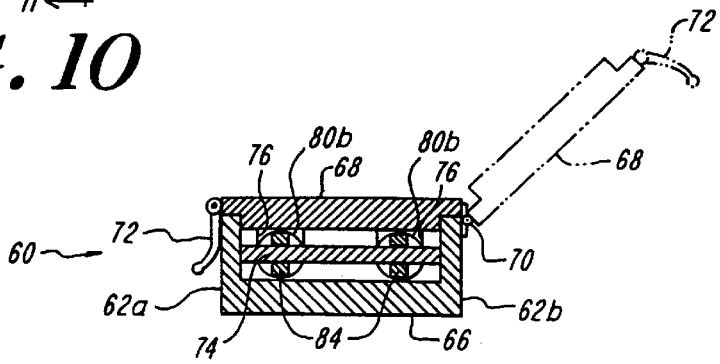
FIG. 11 is a cross sectional view taken along line 11—11 of FIG. 10.

Another embodiment of a clasp assembly in accordance with the present invention is generally depicted at 60 in FIGS. 9–11. The clasp assembly 60 comprises a housing having side walls 62*a*, 62*b*, end walls 64*a*, 64*b*, a bottom wall 66, and a cover 68 connected to the side wall 62*b* as at 70 for pivotal movement between an open position as shown in FIG. 9 and a closed position as shown in FIGS. 10 and 11. A latch 72 serves to reliably retain the cover in its closed position.

A locking pin 74 spans the interior of the housing between the side walls 62*a*, 62*b*. End wall 64*a* is provided with notches 76, and end wall 64*b* is thickened and provided with blind bores 78 configured and dimensioned to receive strand ends 80*a*, the latter being secured in the bores by screws 82 or the like.

The opposite strand ends 80*b* are received in the notches 76 of end wall 64*a* and terminate in hook-shaped ends 84 configured to coact in mechanical interengagement with the locking pin 74. Once the hook-shaped ends are thus engaged, the cover 68 is closed and secured in place by the latch 72.

The hook-shaped ends 84 are configured to pass through jewelry components being slidably mounted on the strands, and are readily detached from and reconnected to the clasp housing by simply opening the cover 68 to allow engagement and disengagement of the hook-shaped ends onto and off of the locking pin 74.

It will now be appreciated that various modifications can be made to the embodiments herein disclosed without departing from the spirit and scope of the invention. By way of example, and without limitation, the shape of the clasp housings and their operable components may be varied, and different catch mechanisms may be employed.

It is our intention to cover these and any other changes or modifications to the disclosed embodiments which are encompassed by the claims appended hereto.

We claim:

1. A clasp assembly for separably coupling the first and second ends of at least one flexible strand on which jewelry components are slidably mounted, said clasp assembly comprising:

a housing having a first opening communicating with an internal chamber and a second opening communicating with an external recess;

a catch on the first end of said strand, said catch being receivable in said internal chamber via said first opening to separably connect said first strand end to said housing;

said second strand end being receivable in said recess via said second opening; and a latch on said housing, said latch being pivotally adjustable between an open position removed from said recess, and a closed position received in said recess to coact in interengagement with said second strand end and to separably connect said second strand end to said housing.

2. The combination as claimed in claim 1 wherein said second strand end is configured and dimensioned to pass through openings in said jewelry components.

3. The clasp assembly as claimed in claim 1 wherein said second strand end is provided with a notch for engaging said latch when said latch is in said closed position.

4. The clasp assembly as claimed in claim 1 further comprising a second latch on said housing, said second latch being pivotally adjustable between an unlocked position permitting adjustment of said latch between said open and closed positions, and a locked position retaining said first mentioned latch in said closed position.

5. The combination as claimed in claim 1 wherein said catch is resiliently configured and dimensioned to coact in releasable snap engagement with said housing.

6. The combination as claimed in claim 1 wherein said jewelry components are slidably mounted on multiple parallel flexible strands, each having first and second ends.

7. The combination as claimed in claim 6 wherein the first ends of said strands are interconnectable by said clasp, and wherein the second ends of said strands are receivable in said recess via multiple second openings.

8. The clasp assembly as claimed in claim 1 wherein said housing is provided with first and second end walls and an intermediate wall disposed between said end walls to separate said interior chamber from said external recess.

9. The clasp assembly as claimed in claim 8 wherein said first and second openings extend respectively through said first and second end walls.

10. The clasp assembly as claimed in claim 1 further comprising a second latch on said catch, said second latch being pivotally adjustable between an open position accommodating insertion into and removal of said catch from said internal chamber, and a locked position retaining said catch in said internal chamber.

11. An article of jewelry comprising in combination:

at least one jewelry piece;

a flexible strand of finite length having first and second ends, the second end of said strand being configured and dimensioned to be passed through said jewelry piece to accommodate slidable mounting of said jewelry piece on said strand;

a clasp housing;

means for separably attaching the first end of said strand to said clasp housing;

an opening in said housing configured and dimensioned to accommodate introduction and removal of the second end of said strand into and from said housing; and closure means mounted on and movable relative to said clasp housing between an open position accommodating introduction and removal of the second end of said strand into and from said housing, and a latched position capturing the second end of said strand in said clasp housing.

12. The combination as claimed in claim 11 wherein said opening communicates with an internal chamber spanned by a locking pin, and wherein the second end of said strand is configured to coact in mechanical interengagement with said locking pin.

13. The combination as claimed in claim 12 wherein said closure means comprises a cover configured and arranged when in its latched position to close said chamber and to retain the second end of said strand in mechanical interengagement with said pin.

14. The combination of a flexible strand of finite length which jewelry components are slidably mounted, and a clasp assembly for separably coupling first and second ends of said flexible strand, said combination comprising:

a housing having a first opening communicating with an internal chamber and a second opening communicating with an external recess;

a catch on the first end of said strand, said catch being receivable in said internal chamber via said first opening to separably connect said first strand end to said housing;

said second strand end being receivable in said recess via said second opening; and a latch on said housing, said latch being pivotally adjustable between an open position removed from said recess, and a closed position received in said recess and coacting in interengagement with said second strand end to separably connect said second strand end to said housing.

15. An article of jewelry comprising in combination:

a) a flexible strand of finite length having first and second ends;

b) at least one jewelry piece, the second end of said strand being configured to be passed through said jewelry piece to thereby accommodate slidable interchangeable mounting of said jewelry piece on said strand; and c) a clasp assembly for separably coupling the first and second ends of said strand, said clasp assembly comprising:

(i) a housing;

(ii) means for connecting the first end of said strand to said housing;

(iii) an opening in said housing leading to an external recess, the second end of said strand being receivable in said recess via said opening; and (iv) a latch on said housing, said latch being pivotally adjustable between an open position removed from said recess, and a closed position received in said recess and coacting in interengagement with said second strand end to separably connect said strand end to said housing.

* * * * *